US008919747B2

(12) United States Patent
Anzai et al.

(10) Patent No.: US 8,919,747 B2
(45) Date of Patent: Dec. 30, 2014

(54) SUPER-MICRO BUBBLE GENERATION DEVICE

(75) Inventors: Satoshi Anzai, Kanagawa (JP); Susumu Nishi, Osaka (JP)

(73) Assignees: Nishiken Devise Co., Ltd. (JP); Satoshi Anzai (JP)

( * ) Notice: Subject to any disclaimer, the term of this patent is extended or adjusted under 35 U.S.C. 154(b) by 409 days.

(21) Appl. No.: 13/387,403

(22) PCT Filed: Jul. 28, 2010

(86) PCT No.: PCT/JP2010/062705

§ 371 (c)(1),
(2), (4) Date: Apr. 2, 2012

(87) PCT Pub. No.: WO2011/013706

PCT Pub. Date: Feb. 3, 2011

(65) Prior Publication Data

US 2012/0175791 A1 Jul. 12, 2012

(30) Foreign Application Priority Data

Jul. 30, 2009 (JP) ..... 2009-177693

(51) Int. Cl.
*B01F 3/04* (2006.01)
*B01F 5/02* (2006.01)
*B01F 5/00* (2006.01)

(52) U.S. Cl.
CPC ..... *B01F 3/04262* (2013.01); *B01F 3/0451* (2013.01); *B01F 5/0206* (2013.01); *B01F 5/0256* (2013.01); *B01F 2003/04411* (2013.01);

(58) Field of Classification Search
CPC .. B01F 3/04262; B01F 3/0451; B01F 5/0206; B01F 5/0256; B01F 2003/0441; B01F 2003/04858; B01F 2215/0052; B01F 2003/04886; B01F 2003/04921; B01F 2005/0031; B01F 2005/0034; B01F 2005/0048; B01F 2215/0032; B01F 2003/04872
USPC ..... 261/117, 118, 122.1, DIG. 70
See application file for complete search history.

(56) References Cited

U.S. PATENT DOCUMENTS 1,920,719 A * 8/1933 Stich ..... 261/121.1
2,937,506 A * 5/1960 Stirlen ..... 62/121

(Continued)

FOREIGN PATENT DOCUMENTS

JP 56-47726 U 4/1981
JP 2003-245533 A 9/2003

(Continued)

OTHER PUBLICATIONS

International Search Report for International Application No. PCT/JP2010/062705, mailed Aug. 31, 2010, with English translation.

(Continued)

*Primary Examiner* — Charles Bushey
(74) *Attorney, Agent, or Firm* — Cantor Colburn LLP

(57) ABSTRACT

Provided is a super-micro bubble generation device providing super-micro bubbles using a simple method and having a higher degree of freedom of installation so as to be suitable for a place where the device is to meet functional requirements. A super-micro bubble generation device is provided with a compressor for delivering gas under pressure, and also with a bubble generation medium for discharging the gas, which has been delivered under pressure, as super-micro bubbles into liquid. The bubble generation medium consists of a high-density compound which is an electrically conductive substance. The super-micro bubble generation device is also provided with a liquid jetting device for jetting liquid in the direction substantially perpendicular to the direction in which the bubble generation medium discharges the super-micro bubbles, said liquid being the same kind of liquid as the liquid into which the super-micro bubbles are discharged.

2 Claims, 7 Drawing Sheets

(52) U.S. Cl.
CPC ..... *B01F 2003/04858* (2013.01); *B01F 2003/04872* (2013.01); *B01F 2003/04886* (2013.01); *B01F 2003/04921* (2013.01); *B01F 2005/0031* (2013.01); *B01F 2005/0034* (2013.01); *B01F 2005/0048* (2013.01); *B01F 2215/0032* (2013.01); *B01F 2215/0052* (2013.01)
USPC ..... 261/117; 261/122.1

(56) References Cited

U.S. PATENT DOCUMENTS 5,560,874 A * 10/1996 Sheckler et al. ..... 261/122.1
7,686,284 B2 * 3/2010 Henley ..... 261/28
7,900,895 B1 * 3/2011 Farrell et al. ..... 261/77
2006/0244160 A1 * 11/2006 Pakdaman ..... 261/122.1

FOREIGN PATENT DOCUMENTS

JP 2005-334869 A 12/2005
JP 2006-61817 A 3/2006
JP 2007-260529 A 10/2007
JP 2008-132437 A 6/2008
JP 2009-101250 A 5/2009

OTHER PUBLICATIONS

Decision of Refusal for Japanese Patent Application No. 2009-177693; Date of Mailing: Sep. 16, 2014, with English translation.

* cited by examiner (a)

(b)

(a)

(b)

(c)

SUPER-MICRO BUBBLE GENERATION DEVICE

CROSS REFERENCE TO RELATED APPLICATIONS

This is a U.S. national stage of application No. PCT/JP2010/062705, filed on Jul. 28, 2010. Priority under 35 U.S.C. §119(a) and 35 U.S.C. §365(b) is claimed from Japanese Application No. 2009-177693, filed Jul. 30, 2009, the disclosure of which is also incorporated herein by reference.

TECHNICAL FIELD

The present invention relates to an art of a super-micro bubble generation device which can generate super-micro bubbles in liquid.

BACKGROUND ART

In recent years, the art of utilizing super-micro bubbles of several hundred nm to several dozen μm in size (diameter) has been attracting attention. The super-micro bubbles are used in liquid such as tap water, the water of lakes and marshes or rivers, or marine water or the like. The said super-micro bubbles have the property that the surface areas thereof are very large. The said super-micro bubbles also have physio-chemical property such as self-pressure effect. Technology of utilizing the characteristics of such micro bubbles in effluent purification, purification, physical care in the bathtub, and the like has been developing.

One method for generating the super-micro bubbles having the said properties has become public knowledge. That method has steps of, spinning around motor in liquid; raising the flow rate by pump pressure; inhaling the air; and stirring. As such, bubbles are generated. The generated bubbles are then torn into super-micro bubbles by a rotating wing or a cutting tool. Moreover, another method for generating the super-micro bubbles has also become public knowledge. In that method, a liquid jetting nozzle is disposed around an air jetting nozzle, and bubbles jetted from the air jetting nozzle are torn into super-micro bubbles by the force of jet flow of the liquid jetting nozzle. Furthermore, another method for generating the super-micro bubbles has also become public knowledge. In that method, bubbles are generated by stirring, and the generated bubbles go through the eyes of a mesh membrane so as to fine down to super-micro bubbles (for example, see Patent Literature 1).

PRIOR ART DOCUMENTS

Patent Literature

Patent Literature 1: the Japanese Patent Laid Open Gazette 2009-101250

DISCLOSURE OF INVENTION

Problems to be Solved by the Invention

By using the conventional method of spinning around motor in liquid; raising the flow rate by pump pressure; inhaling the air; stirring; and tearing into super-micro bubbles by the rotating wing or the cutting tool, it is able to generate large amount of super-micro bubbles. However, fast rotation of the rotating wing or the cutting tool will cause corrosion due to cavitation or abrasion of devices. These will lead to significant damage, and thus, durability will become a problem. When the process liquid, discharged water, or the lakes and marshes or rivers, or marine water or the like with very poor quality is used, deterioration will proceed because the liquid directly contact to the device.

Meanwhile, when the method of which the generated bubbles go through the eyes of the mesh membrane so as to fine down to super-micro bubbles is applied, the mesh membrane will become depleted in the long run since the mesh membrane is made of organic substance. Moreover, when the mesh membrane is provided at right angle with liquid surface, the generated super-micro bubbles will overlap with other super-micro bubbles and will coalesce in a mass bubble. To avoid this, the mesh membrane should be provided parallel to the liquid surface, that is, installation method is limited.

Moreover, when the method of which the liquid jetting nozzle is disposed around the air jetting nozzle and bubbles jetted from the air jetting nozzle are torn into super-micro bubbles by the force of jet flow of the liquid jetting nozzle is applied, it is difficult to stabilize the particle size because there is limitation in pore size of the nozzle.

Therefore, considering the above-mentioned problems, the object of the present invention is to provide a super-micro bubble generation device which can generate super-micro bubbles using a simple method and can be installed by a method which provides a higher degree of freedom of installation to enable the device to be designed so as to be suitable for a place where the device is to be installed and to meet functional requirements.

Means for Solving the Problems

The above-mentioned problems are solved by the following means.

Briefly stated, a super-micro bubble generation device of the present invention comprises: a compressor for delivering gas under pressure, and a bubble generation medium for discharging the gas, which has been delivered under pressure, as super-micro bubbles into liquid, wherein the said bubble generation medium consists of a high-density compound which is an electrically conductive substance. The said super-micro bubble generation device further comprises a liquid jetting device for jetting liquid in the direction substantially perpendicular to the direction in which the bubble generation medium discharges the super-micro bubbles, said liquid being the same kind of liquid as the liquid into which the super-micro bubbles are discharged.

With regard to the super-micro bubble generation device of the present invention, the said bubble generation medium is formed into a conical shape. The gas from the said compressor passes through the said bubble generation medium from a bottom face of the cone toward a vertex, wherein the said liquid being the same kind of liquid as the liquid into which the super-micro bubbles are discharged is jetted toward the vertex of the cone of the said bubble generation medium by the said liquid jetting device.

With regard to the super-micro bubble generation device of the present invention, an outer periphery of the said bubble generation medium is covered with a covering material, wherein the said covering material has the property of lowering the contact angle at which the liquid meets the surface of the said covering material.

Effect of the Invention

The present invention constructed as the above brings the following effects.

According to the super-micro bubble generation device of the present invention, the bubble generation medium consisting of the high-density compound would not deteriorate due to expansion and contraction since the high-density compound is a solid substance which does not have flexibility. Also, the high-density compound would not become eroded due to temporal change since it is made of inorganic material. Thus, the super-micro bubble generation device is prevented from damage and degradation. Also, because the generated super-micro bubbles separates from the bubble generation medium as soon as they are generated, they would not coalesce in a mass bubble. Thus, the super-micro bubbles can be generated by using a simple method. Also, the super-micro bubble generation device can be installed by a method which provides a higher degree of freedom of installation to enable the device to be designed so as to be suitable for a place where the device is to be installed and to meet functional requirements. Moreover, since the said high-density compound is an electrically conductive substance, negatively charged ions tend to range on the surface of the high-density compound. The bubbles generated from the said bubble generation medium become negatively charged by receiving the negatively charged ions from the surface of the high-density compound. The bubbles would not coalesce in a mass bubble since each bubble act repulsively due to this negative electric charge.

According to the super-micro bubble generation device of the present invention, the liquid is jetted toward the vertex of the cone. Then, the liquid will flow along the curved surface of the cone. In this way, it is able to make the size of the injection hole smaller, and thus, lower pressure is needed for jetting the liquid. The generated super-micro bubbles separate from the bubble generation medium as soon as they are generated, and thus, the super-micro bubbles would not coalesce in a mass bubble. As just described, the super-micro bubbles can be generated by using a simple method. Also, the super-micro bubble generation device can be installed by a method which provides a higher degree of freedom of installation to enable the device to be designed so as to be suitable for a place where the device is to be installed and to meet functional requirements. Also, since the said high-density compound is an electrically conductive substance, bubbles generated from the bubble generation medium are negatively charged. The bubbles would not coalesce in a mass bubble since each bubble act repulsively due to this negative electric charge.

According to the super-micro bubble generation device of the present invention, the covering material has the property that contact angle at which the liquid meets the surface of the covering material is low. Accordingly, the surrounding liquid is attracted to the covering material. Thus, a thin liquid film is formed between the super-micro bubbles and the covering material. This makes it easy to separate the super-micro bubbles from the bubble generation medium. Thus, the super-micro bubbles would not coalesce in a mass bubble. Moreover, there is an effect of separating the super-micro bubbles by liquid flow by jetting liquid toward the bubble generation medium coated with the covering material from the liquid jetting device. There is also an effect of separating the super-micro bubbles by making the contact angle, at which the liquid interface meets the surface of the covering material, smaller. Combination of these effects makes it easy to separate super-micro bubbles.

BRIEF DESCRIPTION OF DRAWINGS

FIG. 1(*b*) is an enlarged cross-section view of a bubble generation medium.

FIG. 2(*a*) shows the point when a super-micro bubble is generated, FIG. 2(*b*) shows the point when the super-micro bubble separates from the bubble generation medium, and FIG. 2(*c*) shows the point when a next super-micro bubble is generated.

FIG. 4(*a*) shows the point when a super-micro bubble is generated, FIG. 4(*b*) shows the point when the super-micro bubble separates from the bubble generation medium, and FIG. 4(*c*) shows the point when a next super-micro bubble is generated.

FIG. 5(*b*) is an enlarged cross-section view of a bubble generation medium in accordance with another embodiment.

FIG. 6(*b*) is an oblique drawing showing the overall configuration of a super-micro bubble generation device which is another embodiment of the present invention. FIG. 6(*c*) is an oblique drawing showing the overall configuration of a super-micro bubble generation device which is another embodiment of the present invention.

THE MODE FOR CARRYING OUT THE INVENTION

Next, explanation will be given on the mode for carrying out the invention.

Figure 1:
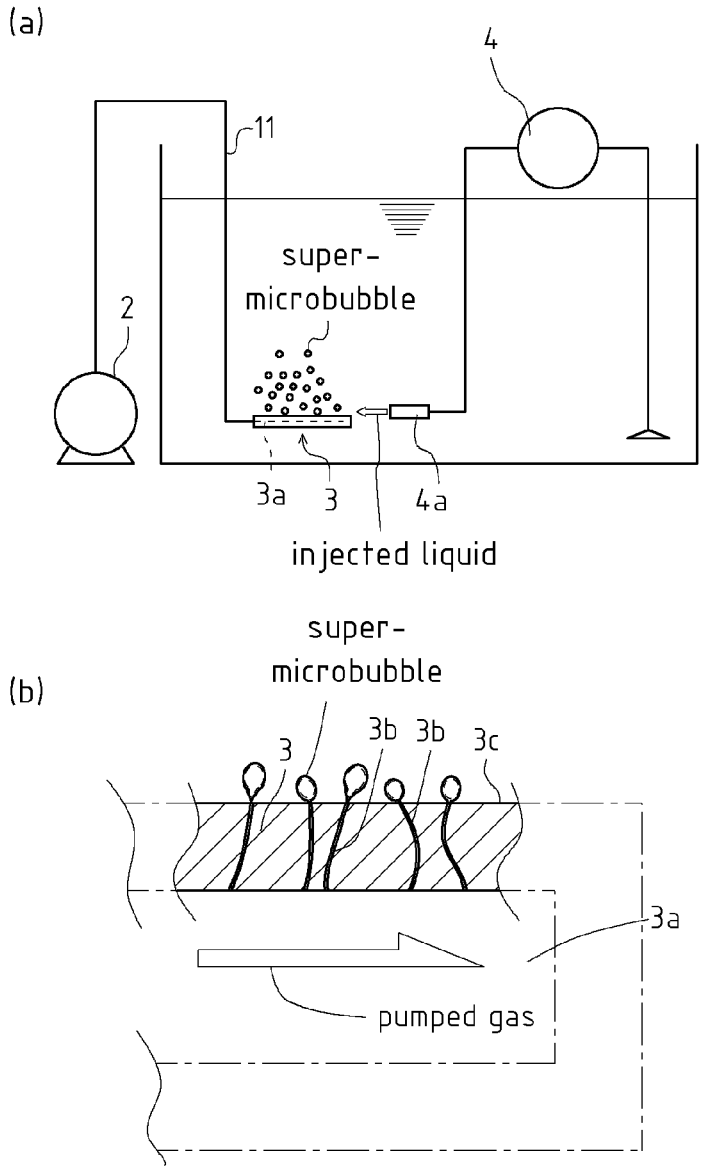
[FIG. 1] FIG. 1(*a*) is a schematic drawing showing the overall configuration of a super-micro bubble generation device which is one embodiment of the present invention.

As shown in FIGS. 1(*a*) and (*b*), a super-micro bubble generation device 1 is provided with a compressor 2 as a compression machine for delivering gas under pressure, and also with a bubble generation medium 3 for discharging the gas, which has been delivered under pressure, as super-micro bubbles into liquid. The super-micro bubble generation device 1 is also provided with a liquid jetting device 4 for jetting liquid being the same kind of liquid as the liquid into which the super-micro bubbles are discharged.

The compressor 2 is a device for delivering gas under pressure into an internal space 3*a* of the bubble generation medium 3 through the intermediary of a gas supply line 11. The gas delivered under pressure by the compressor 2 is not limited to air. For example, the gas may be ozone gas or nitrogen gas. And the said liquid may be such as fresh water or sea water of rivers or lakes, water, or industrial wastewater. Furthermore, the said liquid also may be solvent such as pharmaceutical products. In that case, the pharmaceutical products are stirred or mixed by using the said super-micro bubbles.

The gas delivered under pressure by the compressor 2 passes through the gas supply line 11, and then the gas will be delivered under pressure into the internal space 3*a* of the bubble generation medium 3. The bubble generation medium 3 consists of a high-density compound whose solid texture is made of molecular structure consisting of ionic bonds. Moreover, the said high-density compound is an electrically conductive substance, and thus, bubbles generated from the bubble generation medium 3 are negatively charged. In other words, the super-micro bubbles are negatively charged by addition of free electrons on passing through the bubble generation medium 3, which is the electrically conductive substance. The bubbles would not coalesce in a mass bubble since each bubble act repulsively due to this negative electric charge. For instance, the said electrically conductive substance is made of carbon-based material.

Moreover, as shown in FIG. 1(*b*), the bubble generation medium 3 is porous having a lot of tiny pores 3*b* of several μm to several dozen μm in diameter. Because of this constitution, the gas delivered under pressure by the compressor 2 passes through the said pores 3*b*. In other words, the super-micro bubbles are discharged from the pores 3*b* into liquid by gas tension of the gas delivered under pressure from compressor 2. Because of this constitution, the bubble generation medium 3 consisting of the high-density compound would not deteriorate due to expansion and contraction since the high-density compound is a solid substance which does not have flexibility. Also, the high-density compound would not become eroded due to temporal change since it is made of inorganic material. Thus, the super-micro bubble generation device 1 is prevented from damage and degradation.

Moreover, the bubble generation medium 3 consisting of the high-density compound would not become worn even though liquid flow injected from the liquid jetting device 4 hits the high-density compound because it is activated. Thus, durability of the bubble generation medium 3 has been improved.

The liquid jetting device 4 is a device for separating super-micro bubbles generated from a surface site 3*c* of the bubble generation medium 3 by the liquid flow. The liquid jetting device 4 jets liquid being the same kind of liquid as the liquid into which the super-micro bubbles are discharged. Because of this constitution, the super-micro bubbles can be separated by the liquid flow without influencing fluid composition. Moreover, it is able to prevent different kind of liquid being mixed into the liquid.

Figure 2:
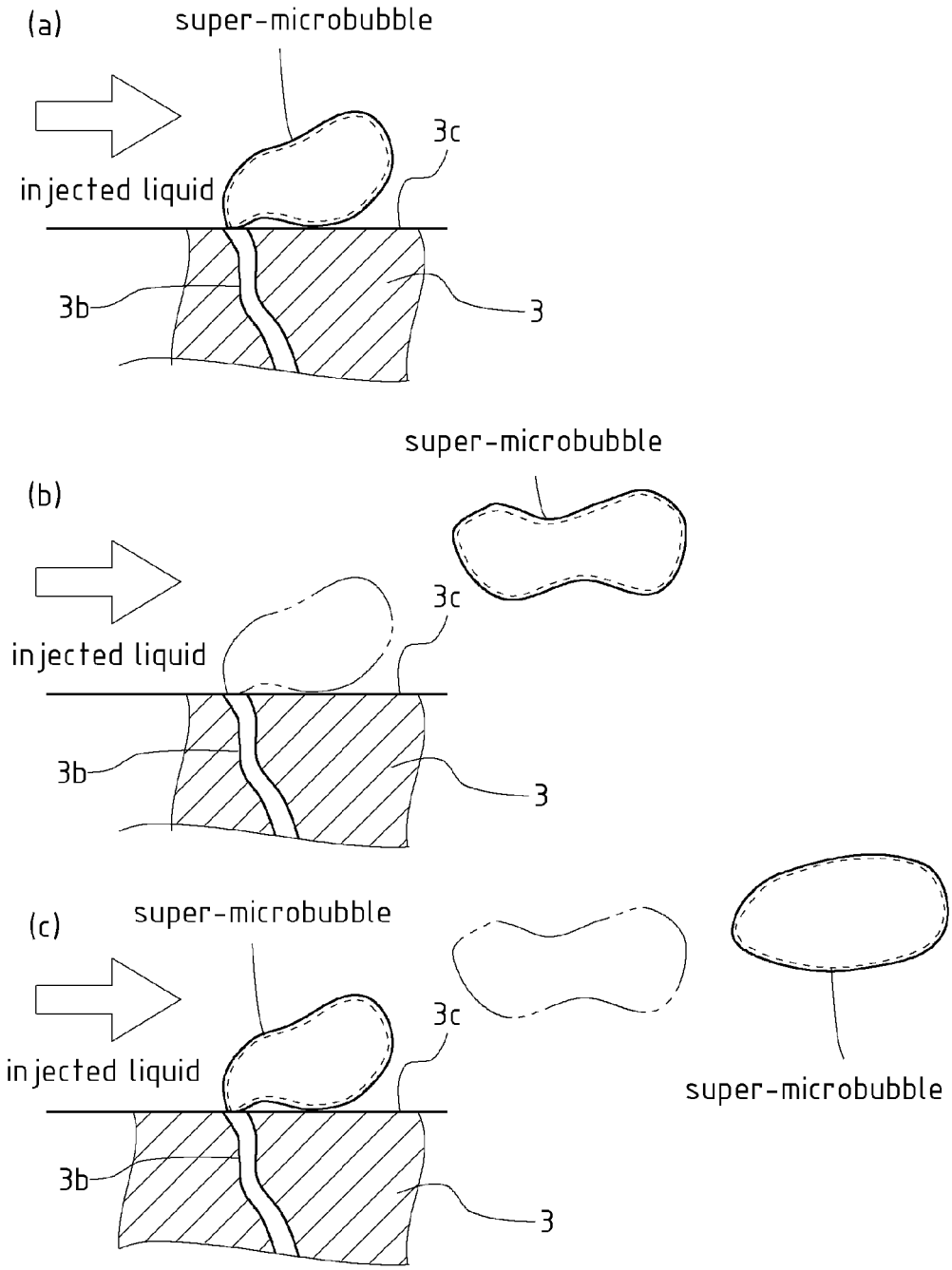
[FIG. 2] It is an enlarged cross-section view of the bubble generation medium.

As shown in FIG. 2(*a*), the said super-micro bubbles are discharged from the tiny pores 3*b*. In that split second, as shown in FIG. 2(*b*), the liquid delivered under pressure by the liquid jetting device 4 rapidly passes through the surface site 3*c*, from where the super-micro bubbles are discharged, so as to separate the super-micro bubbles from the surface site 3*c*.

Thus, as shown in FIG. 2(*c*), the super-micro bubbles discharged from the surface site 3*c* separately move around in the liquid without coalescing with subsequently generated super-micro bubbles or other super-micro bubbles discharged from surrounding pores 3*b*. Because of this constitution, super-micro bubbles can be generated by using a simple method. Moreover, the super-micro bubble generation device 1 can be installed by a method which provides a higher degree of freedom of installation to enable the device to be designed so as to be suitable for a place where the device is to be installed and to meet functional requirements.

Also, the bubble generation medium 3 may be coated with a coating material 5 which is a covering material. The coating material 5 is an inorganic material which has the property that contact angle at which the liquid interface meets the surface of the coating material 5 is low (for example, if the liquid is water, the coating material 5 may be made of superhydrophilic material). In this embodiment, the coating material 5 is made of silica glass. The contact angle signifies wetting force of materials. The value of wetting force will rise as contact angle becomes lower. However, the coating material 5 is not limited to material which is made of silica glass.

The coating material 5 is applied to the surface site 3*c* of the bubble generation medium 3 so as to cover its surface. The silica glass that makes up the coating material 5 has the property of lowering the contact angle at which the liquid interface meets the surface of the coating material 5, and thus the coating material 5 attracts surrounding liquid instead of shedding. In other words, the liquid spreads on the surface of the coating material 5 as thin film rather than forming droplets. Also, the coating material 5 is porous having a lot of tiny pores 5*a* of several μm to several dozen μm in diameter. The pores 5*a* are communicated with the pores 3*b* of the bubble generation medium 3.

Figure 3:
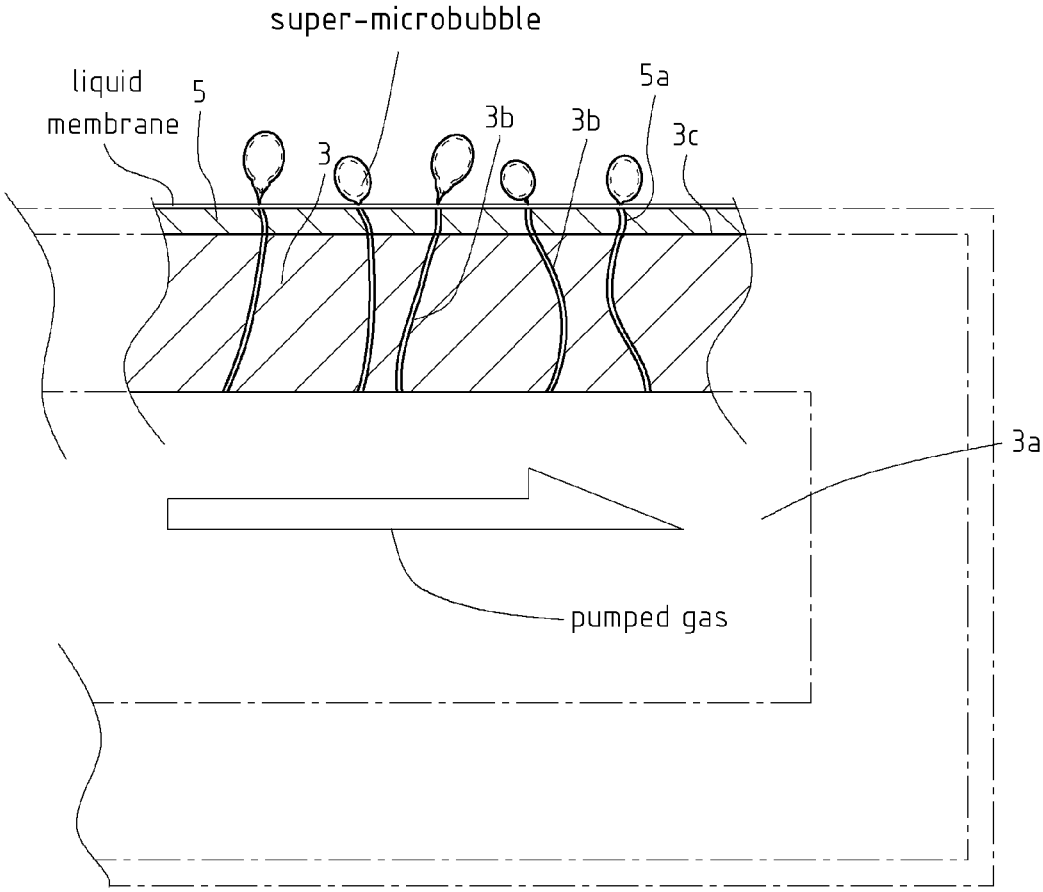
[FIG. 3] It is an enlarged cross-section view of the bubble generation medium coated with a coating material.

As a result, as shown in FIG. 3, the said super-micro bubbles are discharged from the pores 5*a* of the coating material 5 into liquid after passing through the pores 3*b* of the bubble generation medium 3. Here, the coating material 5 has the property that contact angle at which the liquid interface meets the surface of the coating material 5 is low. Because of this, the wetting force of the coating material 5 is high. The surrounding liquid is attracted to the coating material 5. Thus, a thin liquid film is formed between the super-micro bubbles and the coating material 5. This makes it easy to separate the super-micro bubbles from the bubble generation medium 3. Thus, the super-micro bubbles would not coalesce in a mass bubble.

Moreover, there is an effect of separating the super-micro bubbles by liquid flow by jetting liquid toward the bubble generation medium 3 coated with the coating material 5 from the liquid jetting device 4. There is also an effect of separating the super-micro bubbles by making the contact angle, at which the liquid interface meets the surface of the coating material 5, smaller. Combination of these effects makes it easy to separate super-micro bubbles.

Figure 4:
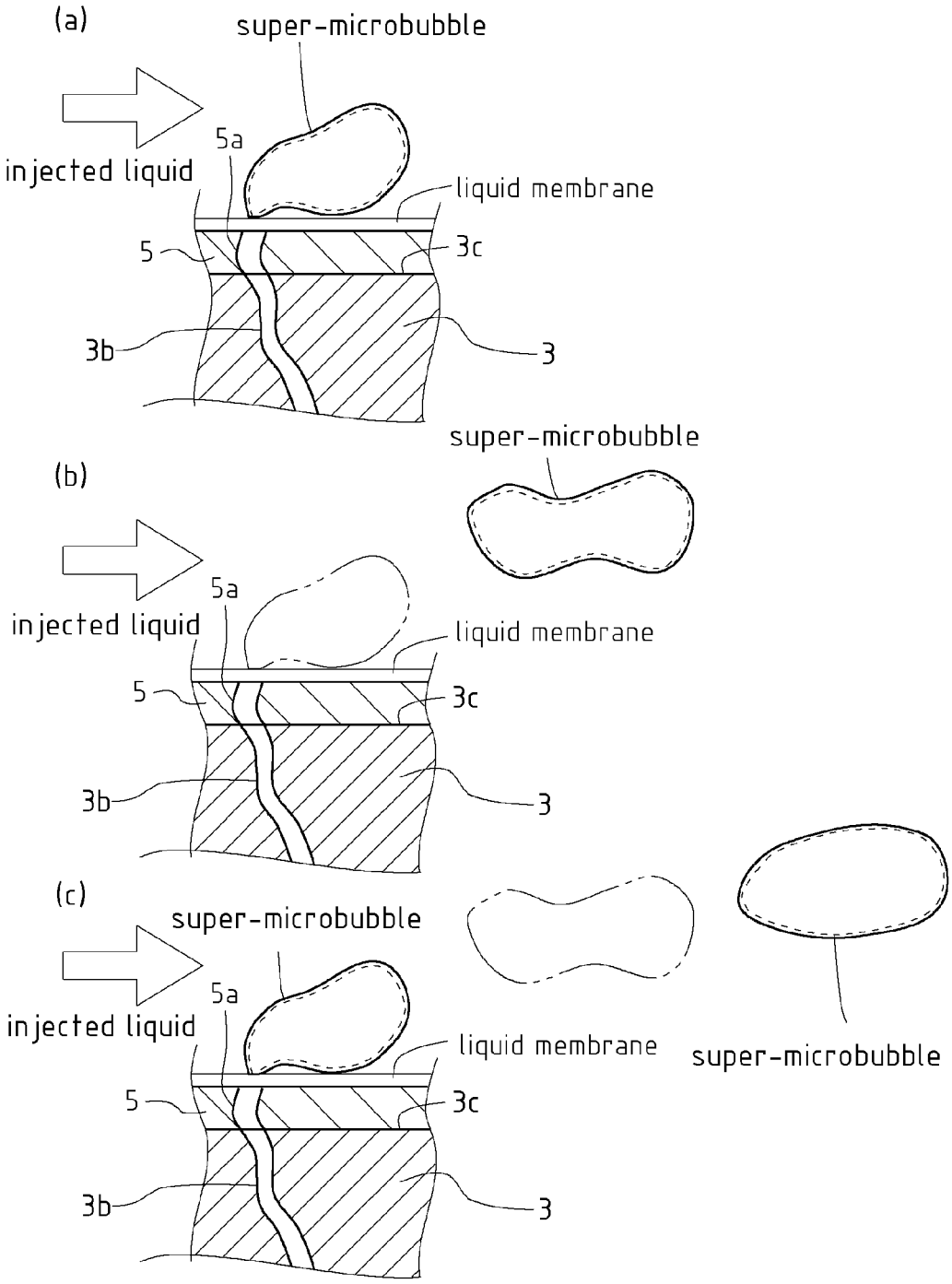
[FIG. 4] It is an enlarged cross-section view of the bubble generation medium.

As shown in FIG. 4(*a*), the super-micro bubbles are generated from the pores 5*a* after passing through the pores 3*b*. The super-micro bubbles are easily separated from the surface of the coating material 5 because the thin liquid film is formed on the surface of the coating material 5 whereby the super-micro bubbles are generated. In other words, the super-micro bubbles can be easily separated because the liquid film lies between the super-micro bubbles and the coating material 5.

Also, as shown in FIG. 4(*b*), the super-micro bubbles are generated from the pores 5*a*. In that split second, the liquid delivered under pressure by the liquid jetting device 4 rapidly passes through the surface of the coating material 5. Thus, the super-micro bubbles are separated from the surface site 3*c* of the bubble generation medium 3.

For this reason, as shown in FIG. 4(*c*), the super-micro bubbles which dwell on the surface of the coating material 5 will separately move around in the liquid without coalescing with subsequently generated super-micro bubbles or other super-micro bubbles discharged from surrounding pores 5*a*. Because of this constitution, the super-micro bubbles can be generated by using a simple method. Also, the super-micro bubble generation device 1 can be installed by a method which provides a higher degree of freedom of installation to enable the device to be designed so as to be suitable for a place where the device is to be installed and to meet functional requirements.

Next, explanation will be given on the configuration of the bubble generation medium 3.

Figure 5:
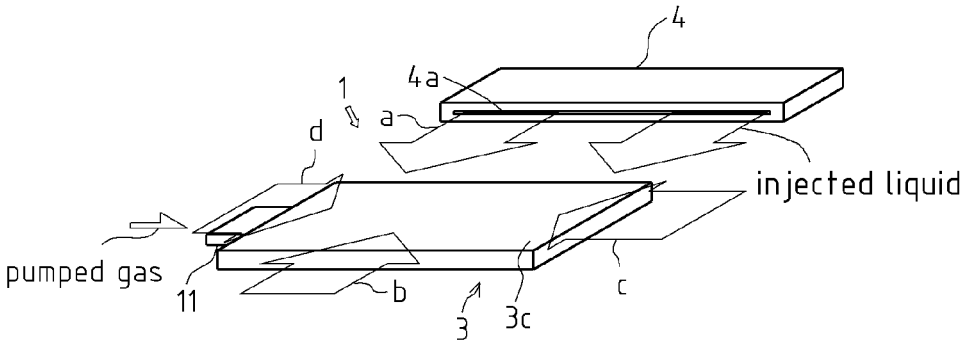
[FIG. 5] FIG. 5(*a*) is a schematic drawing showing the overall configuration of a super-micro bubble generation device which is another embodiment of the present invention.
Figure 5:
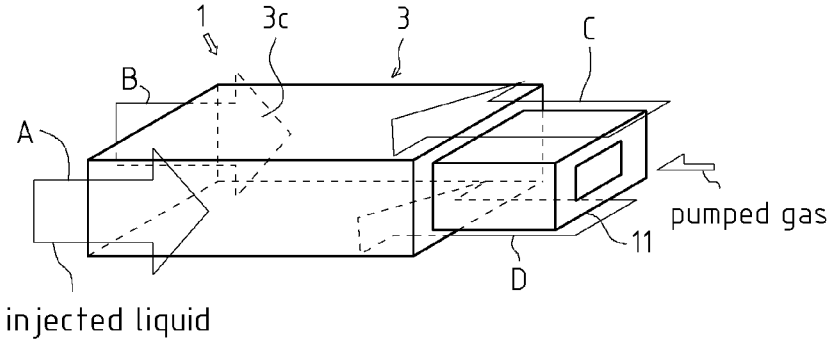

As shown in FIG. 5(*a*), the bubble generation medium 3 is formed into a tabular shape. The super-micro bubbles are generated from the surface site 3*c*, whose plate area is wider than any other plate face of the bubble generation medium 3. Because the bubble generation medium 3 is formed into a tabular shape with wide surface area, the super-micro bubbles can be generated effectively. Also, because the super-micro bubbles separates from the bubble generation medium 3 as soon as they are generated, they would not coalesce in a mass bubble.

Also, the liquid jetting device 4 is a device for jetting liquid in the direction substantially perpendicular to the direction in which the bubble generation medium 3 discharges the super-micro bubbles, that is, jetting liquid in the direction parallel to the surface site 3*c*, which is the widest of all of plate faces of the generation medium 3. The direction of jetting liquid is sufficient if the said direction is substantially perpendicular to the direction in which the super-micro bubbles are discharged, that is, the said direction may be any direction shown in FIG. 5(*a*) as arrow a, arrow b, arrow c, or arrow d. For example, the liquid jetting device 4 has an injection hole 4*a* for jetting liquid flow toward the surface site 3*c* of the plate face of the bubble generation medium 3. The said liquid flow, whose width is as same as that of the surface site 3*c* of the plate face of the bubble generation medium 3, is jetted in the direction parallel to the plate face.

Because of this constitution, as shown in FIG. 2, the generated super-micro bubbles separate from the bubble generation medium 3 as soon as they are generated, and thus, the super-micro bubbles would not coalesce in a mass bubble. As just described, the super-micro bubbles can be generated by using a simple method. Also, the super-micro bubble generation device 1 can be installed by a method which provides a higher degree of freedom of installation to enable the device to be designed so as to be suitable for a place where the device is to be installed and to meet functional requirements.

Moreover, as shown in FIG. 5(*b*), the super-micro bubble generation device 1 in accordance with another embodiment is formed into a hollow polygonal shape. In this embodiment, the bubble generation medium 3 is formed into a hollow square pillar shape. Because of this constitution, gas is discharged from each surface site 3*c* of the square pillar equivalently. The surface sites 3*c* corresponds to longitudinally side walls of the square pillar shape. Thus, the super-micro bubbles can be generated effectively.

Moreover, as shown in FIG. 5(*b*), the liquid is jetted in the same direction parallel to two side walls, which comprise opposing side walls of the square pillar shaped bubble generation medium 3, that is, along the surface of the two side walls in the same direction (direction of arrow A and arrow B). The liquid is also jetted in the same direction parallel to the other two side walls, that is, in the direction opposite to arrow A and arrow B (direction of arrow C and arrow D).

Furthermore, the liquid jetting direction is not limited to such directions shown in this embodiment. For example, the liquid may be jetted in the same direction parallel to all of the side walls. Alternatively, the liquid may be jetted in the same direction parallel to three of the side walls and in the opposite direction parallel to the other side wall.

Figure 6:
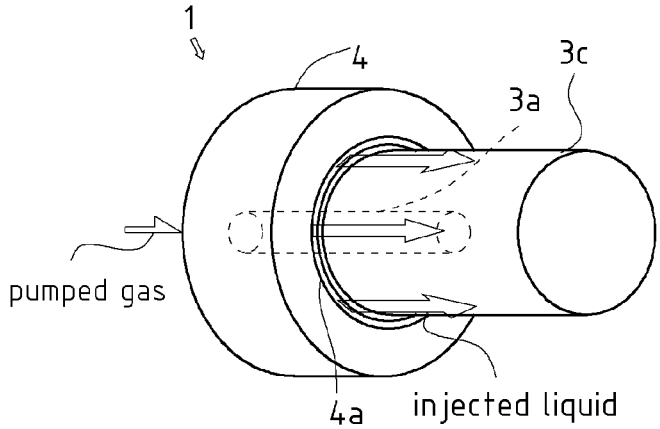
[FIG. 6] FIG. 6(*a*) is an oblique drawing showing the overall configuration of a super-micro bubble generation device which is another embodiment of the present invention.
Figure 6:
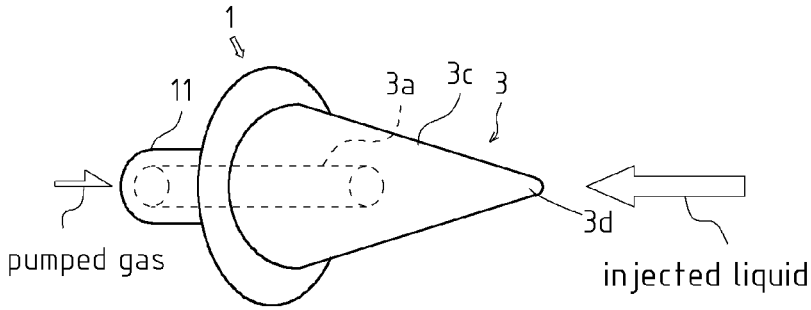
Figure 6:
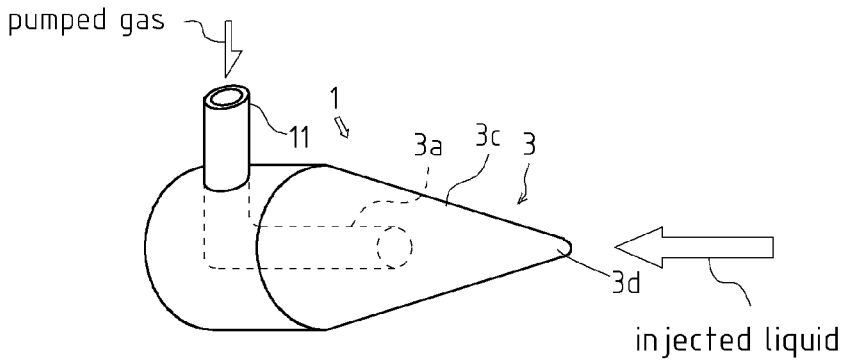

Moreover, as shown in FIG. 6(*a*), the super-micro bubble generation device 1 in accordance with another embodiment includes the bubble generation medium 3 which is formed into a hollow columnar shape. The gas which has been delivered under pressure passes through the gas supply line 11, and then the gas will be delivered in the columnar shaped internal space 3*a* which is provided in the central part of the bubble generation medium 3. Because of this constitution, the gas is discharged from the surface site 3*c*, which is the side wall of the column, equivalently in every direction. Thus, the super-micro bubbles can be generated effectively.

Moreover, as shown in FIG. 6(*a*), the liquid jetting device 4 is provided on the periphery of the gas supply line 11. An injection hole 4*a* of the liquid jetting device 4 is formed into a circular shape having a diameter slightly larger than that of the periphery of the bubble generation medium 3. The liquid jetting device 4 jets zonal liquid flow along the surface site 3*c* in the direction same as gas supplying direction. The surface site 3*c* corresponds to longitudinally side wall of the bubble generation medium 3. In this way, the generated super-micro bubbles separate from the bubble generation medium 3 as soon as they are generated, and thus, the super-micro bubbles would not coalesce in a mass bubble. As just described, the super-micro bubble generation device 1 can be installed by a method which provides a higher degree of freedom of installation to enable the device to be designed so as to be suitable for a place where the device is to be installed and to meet functional requirements.

Furthermore, the liquid jetting direction is not limited to such directions shown in this embodiment. For example, the liquid may be jetted in a direction opposite to the gas supplying direction.

Moreover, as shown in FIG. 6(*b*), the super-micro bubble generation device 1 in accordance with another embodiment includes the bubble generation medium 3 which is formed into a conical shape. The internal space 3*a* is provided on the principal axis part of section of the said conical shape. The gas delivered under pressure by compressor 2 passes through the gas supply line 11, and then the gas will be delivered under pressure into the internal space 3*a* of the bubble generation medium 3. Because of this constitution, the gas is discharged from the surface site 3*c*, which is the side wall of the cone, equivalently in every direction. Thus, the super-micro bubbles can be generated effectively.

Moreover, the liquid jetting device 4 is facing the bubble generation medium 3. In other words, as shown in FIG. 6(*b*), the injection hole 4*a* of the liquid jetting device 4 is disposed on the extension line that extends from a vertex 3*d* of the cone of the bubble generation medium 3. The liquid jetting device 4 is a device for jetting liquid toward the vertex 3*d* of the cone. As just described, since the liquid is jetted toward the vertex 3*d* of the cone, the liquid will flow radially along the surface site 3*c*, which is the side wall of the bubble generation medium 3. In other words, the liquid is jetted in the direction substantially perpendicular to the direction in which the bubble generation medium 3 discharges the super-micro bubbles.

In this way, it is able to make the size of the injection hole 4*a* smaller, and thus, lower pressure is needed for jetting the liquid. The generated super-micro bubbles separate from the bubble generation medium 3 as soon as they are generated, and thus, the super-micro bubbles would not coalesce in a mass bubble. As just described, the super-micro bubbles can be generated by using a simple method. Also, the super-micro bubble generation device 1 can be installed by a method which provides a higher degree of freedom of installation to enable the device to be designed so as to be suitable for a place where the device is to be installed and to meet functional requirements.

Also, as shown in FIG. 6(*c*), a gas supplying inlet port of the gas supply line 11 may be provided in the direction perpendicular to the height direction of the cone of the bubble generation medium 3. Because of this constitution, it is able to make an effective use of space downstream of the liquid flow. Although the gas supplying inlet port of the gas supply line 11 in this embodiment is provided upside of the bubble generation medium 3, the position of the gas supplying inlet port is not limited to this. For example, the gas supplying inlet port may be provided in the horizontal direction.

Figure 7:
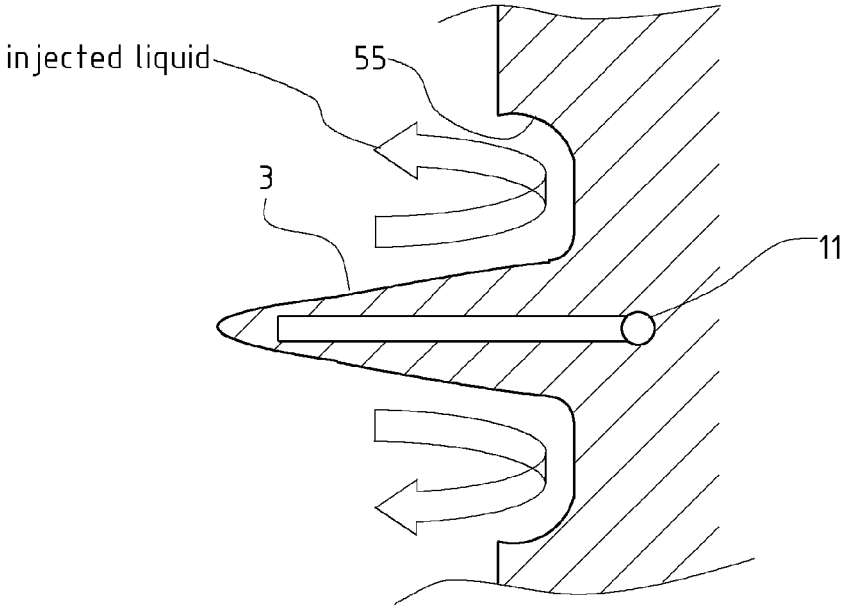
[FIG. 7] It is a cross-section view of the super-micro bubble generation device in accordance with another embodiment of the present invention.

Moreover, a bubble guide groove 55, which is formed around the bubble generation medium 3, is provided downstream of the liquid flow jetted from the liquid jetting device 4. As shown in FIG. 7, the bubble guide groove 55 is formed into an arc-like shape in the cross section view, located downstream of the liquid flow. The bubble guide grove 55 guides the direction of super-micro bubbles movement. The micro bubbles move from the surface site 3*c* of the bubble generation medium 3 by the liquid flow jetted from the liquid jetting device 4. Because of existence the bubble guide groove 55, the super-micro bubbles which are separated from the bubble generation medium 3 will impinge on the bubble guide groove 55. After impingement, the super-micro bubbles will move along the bubble guide groove 55. Thus, it is able to preserve a distance between each super-micro bubble. Accordingly, the super-micro bubbles would not coalesce in a mass bubble.

Moreover, the bubble generation medium 3 and the liquid jetting device 4, which comprise the super-micro bubble generation device 1, may be configured in a unified manner. If constituted in this manner, positional relationship between the generation medium 3 and the injection hole 4*a* of the liquid jetting device 4 is maintained constant consistently. Accordingly, it is able to save many steps for adjusting position thereof. Moreover, a wall surface facing the liquid jetting device 4 may be inclined in an arc-like shape when seen from a side. Because of this constitution, the direction of super-micro bubbles movement can be guided. The super-micro bubbles move along the surface site 3*c* of the plate face of the bubble generation medium 3 by the jetted liquid flow from the liquid jetting device 4. In this way, it is able to preserve a distance between each super-micro bubble. As such, the super-micro bubbles would not coalesce in a mass bubble.

Moreover, the bubble generation medium 3 may be formed into a tabular shape, wherein several gas supply lines 11 are provided in parallel inside the bubble generation medium 3. In this case, the gas passes through the gas supply lines 11, and is delivered under pressure into the internal space 3*a* of the bubble generation medium 3. The gas supply lines 11 are branched inside the bubble generation medium 3. The said branched gas supply lines 11 are arranged in parallel. The super-micro bubbles are generated from the surface site 3*c* of the bubble generation medium 3 by gas pressure from the gas supply lines 11. Keeping wide interval between each gas supply line 11 which is arranged in parallel respectively makes it harder for super-micro bubbles to coalesce in a mass bubble.

However, the numbers or shape of the liquid jetting device is not limited to the state described in this embodiment. For example, more than three liquid jetting devices may be provided. Furthermore, the shape or material of the gas supply line 11 is not limited to the state described in this embodiment. For example, the gas supply line 11 may be a metallic pipe or a plastic pipe.

INDUSTRIAL APPLICABILITY

The super-micro bubble generation device of the present invention is industrially useful because it can generate super-micro bubbles using a simple method and can be installed by a method which provides a higher degree of freedom of installation to enable the device to be designed so as to be suitable for a place where the device is to be installed and to meet functional requirements. In this way, the generated super-micro bubbles separate from the bubble generation medium 3 as soon as they are generated, and thus, the super-micro bubbles would not coalesce in a mass bubble. As just described, the super-micro bubbles can be generated by using a simple method. Also, the super-micro bubble generation device 1 can be installed by a method which provides a higher degree of freedom of installation to enable the device to be designed so as to be suitable for a place where the device is to be installed and to meet functional requirements.

What is claimed is:

1. A super-micro bubble generation device comprising:

a compressor for delivering gas under pressure, and a bubble generation medium for discharging the gas, which has been delivered under pressure, as super-micro bubbles into liquid, wherein the said bubble generation medium consists of a high-density compound made of carbon-based material which is porous having a lot of tiny pores of several μm to several dozen μm in diameter, the said high-density compound being an electrically conductive substance, and further comprising a liquid jetting device for jetting liquid in the direction substantially perpendicular to the direction in which the bubble generation medium discharges the super-micro bubbles, said liquid being the same kind of liquid as the liquid into which the super-micro bubbles are discharged, wherein the said bubble generation medium is formed into a conical shape, and in that the gas from the said compressor passes through the said bubble generation medium from a bottom face of the cone toward a vertex, wherein the said liquid being the same kind of liquid as the liquid into which the super-micro bubbles are discharged is jetted toward the vertex of the cone of the said bubble generation medium by the said liquid jetting device.

2. The super-micro bubble generation device as claimed in claim 1, characterized in that an outer periphery of the said bubble generation medium is covered with a covering material, wherein the said covering material has the property of lowering the contact angle at which the liquid meets the surface of it.

* * * * *